US006065209A

United States Patent [19]

Gondouin

[11] Patent Number: 6,065,209

[45] Date of Patent: May 23, 2000

[54] METHOD OF FABRICATION, TOOLING AND INSTALLATION OF DOWNHOLE SEALED CASING CONNECTORS FOR DRILLING AND COMPLETION OF MULTI-LATERAL WELLS

[75] Inventor: Michael Gondouin, San Rafael, Calif.

[73] Assignee: S-Cal Research Corp., San Rafael, Calif.

[21] Appl. No.: 08/862,636

[22] Filed: May 23, 1997

[51] Int. Cl.[7] ..... B23P 15/00

[52] U.S. Cl. ..... 29/890.14; 29/508

[58] Field of Search ..... 29/890.14, 505, 29/508; 166/380, 117.6, 378

[56] References Cited

U.S. PATENT DOCUMENTS

| | | | |
|---|---|---|---|
| 3,253,841 | 5/1966 | Ahmad | 29/890.14 |
| 3,943,615 | 3/1976 | Smith et al. | 29/890.14 |
| 5,079,824 | 1/1992 | Lopez et al. | 29/890.14 |
| 5,348,211 | 9/1994 | White et al. | 228/120 |
| 5,462,120 | 10/1995 | Goudouin | 166/380 |

*Primary Examiner*—Irene Cuda
*Attorney, Agent, or Firm*—George W. Wasson

[57] ABSTRACT

Multi-lateral wells include one or more connections between a larger diameter well casing and liner-equipped branch-wells of smaller diameter initiated with a small angle deviation from the casing axis, so as to facilitate the sequential insertion of the directional drilling string and of the liner string, used respectively for drilling and for completing each lateral branch. Each such insertion requires, in the casing string, an elliptical window cutout presenting a vertical axis of more than ten feet and a horizontal axis of only a few inches, corresponding to the diameter of the branch-well.

10 Claims, 11 Drawing Sheets

FIG. 2
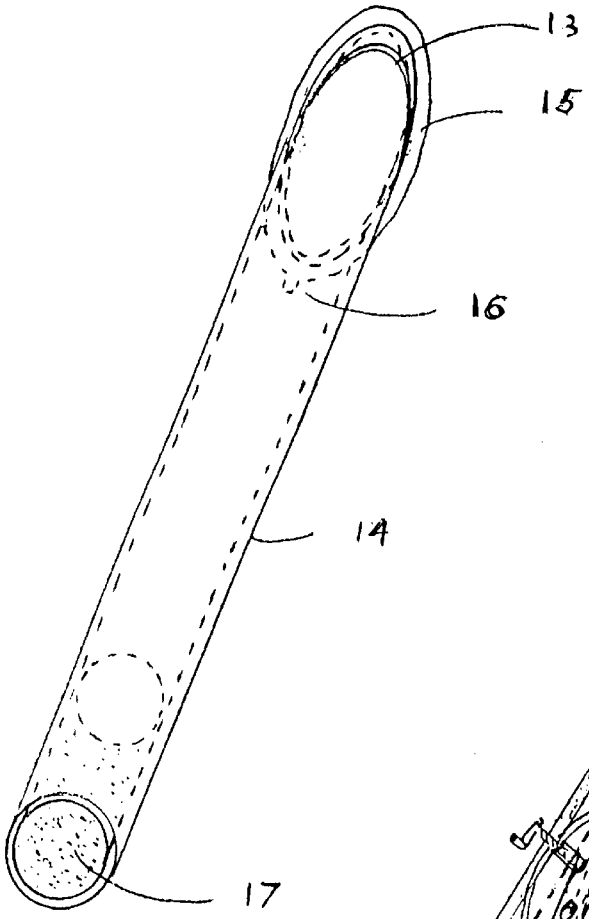
FIG. 3
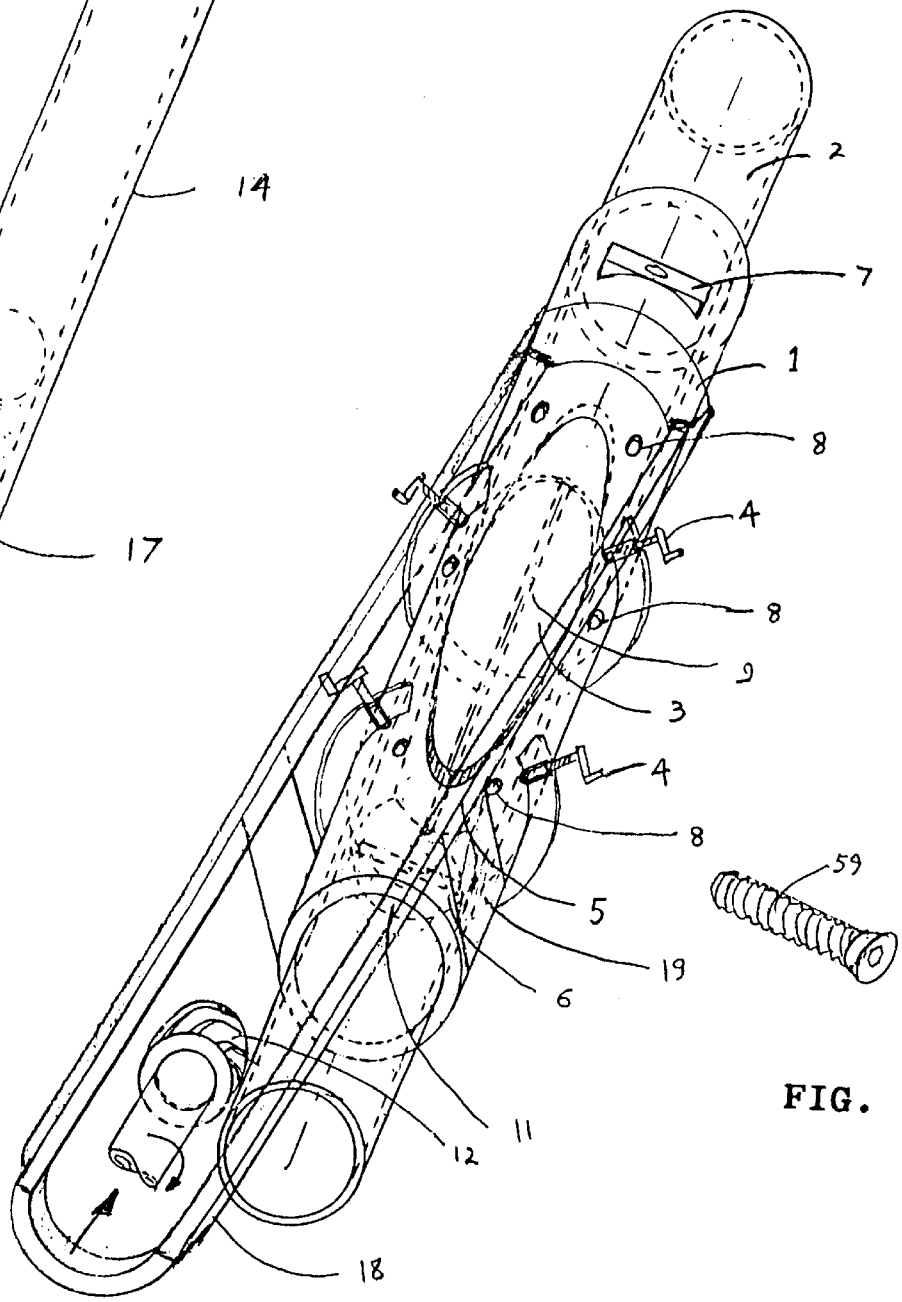
FIG. 3 A

FIG. 6
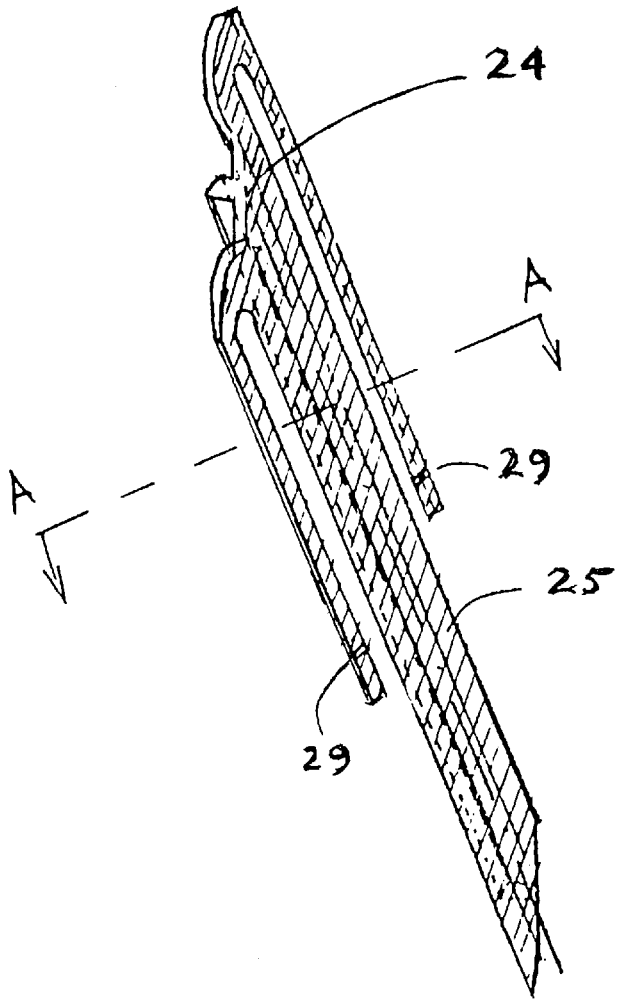
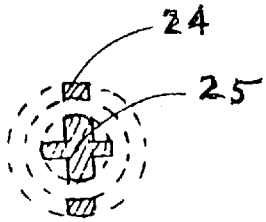
FIG. 6 A

FIG. 8 BB
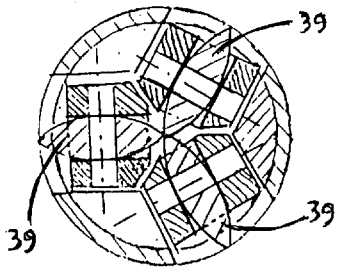
SECTION DD
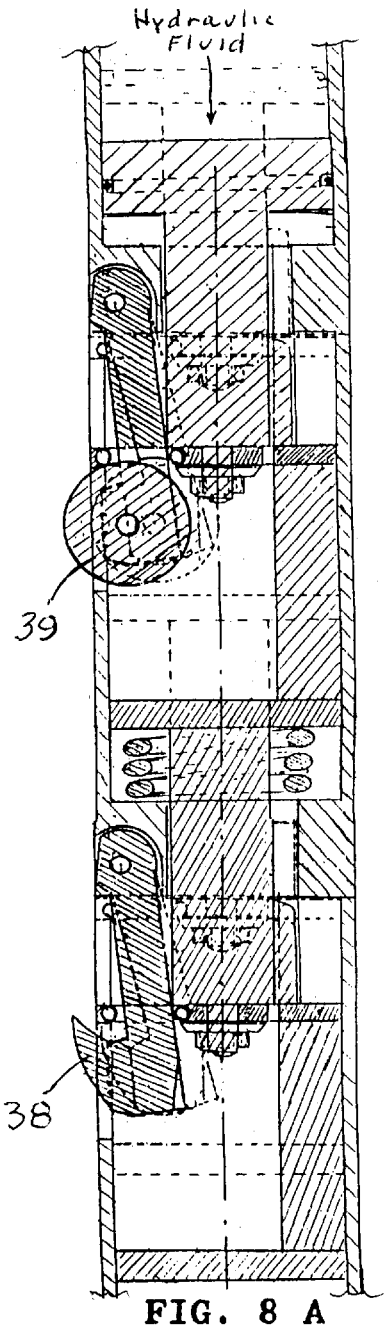
FIG. 8 A
FIG. 8 AA
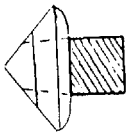
SECTION AA
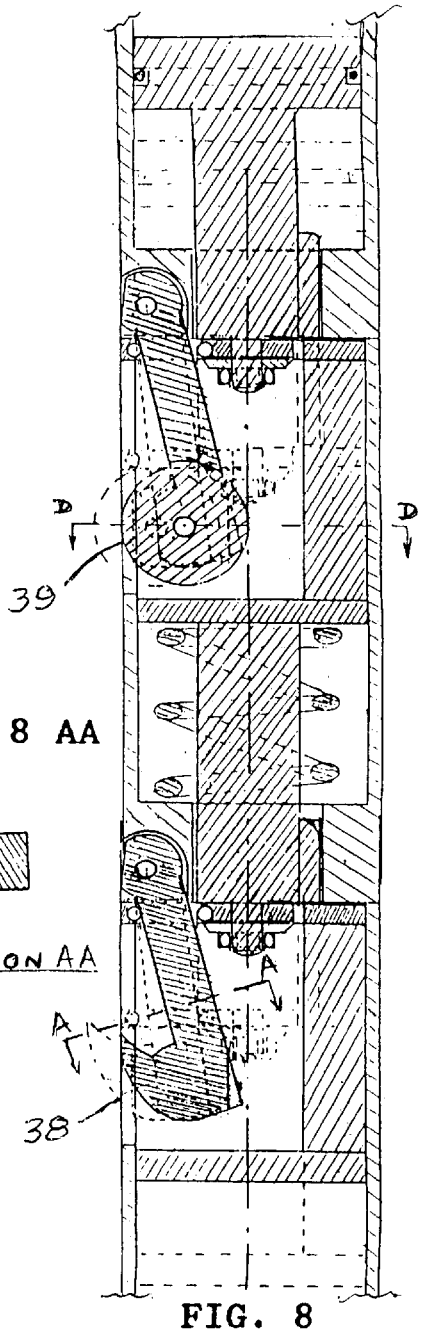
FIG. 8

FIG. 8 B
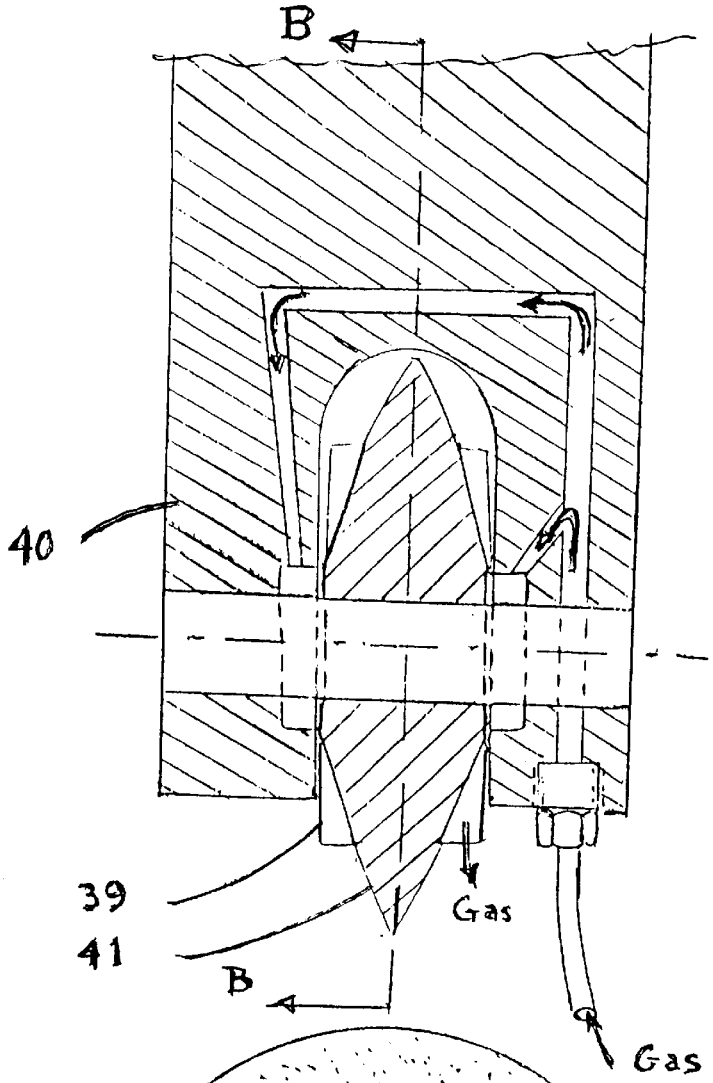
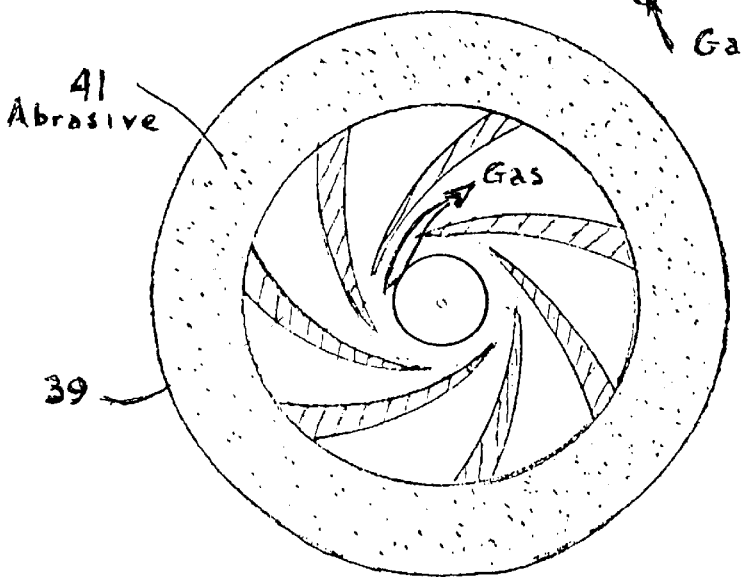
Section BB
FIG. 8 C

FIG. 9 AA
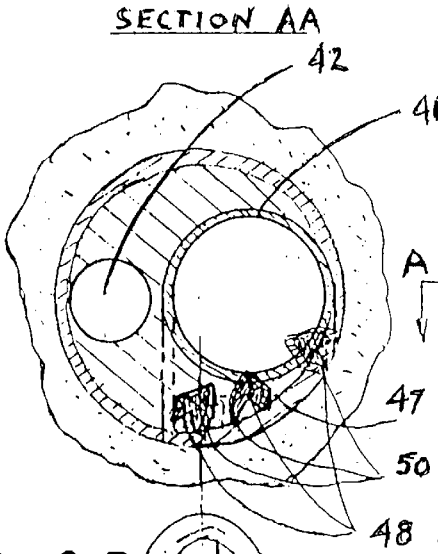
FIG. 9 B
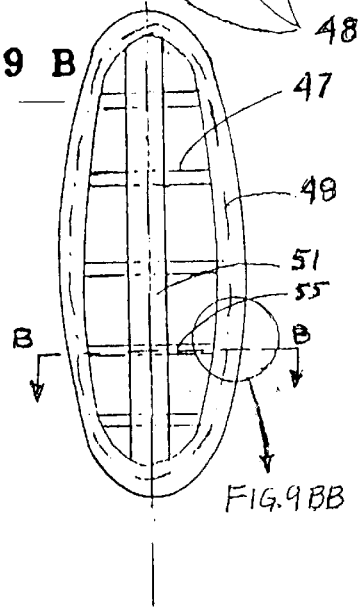
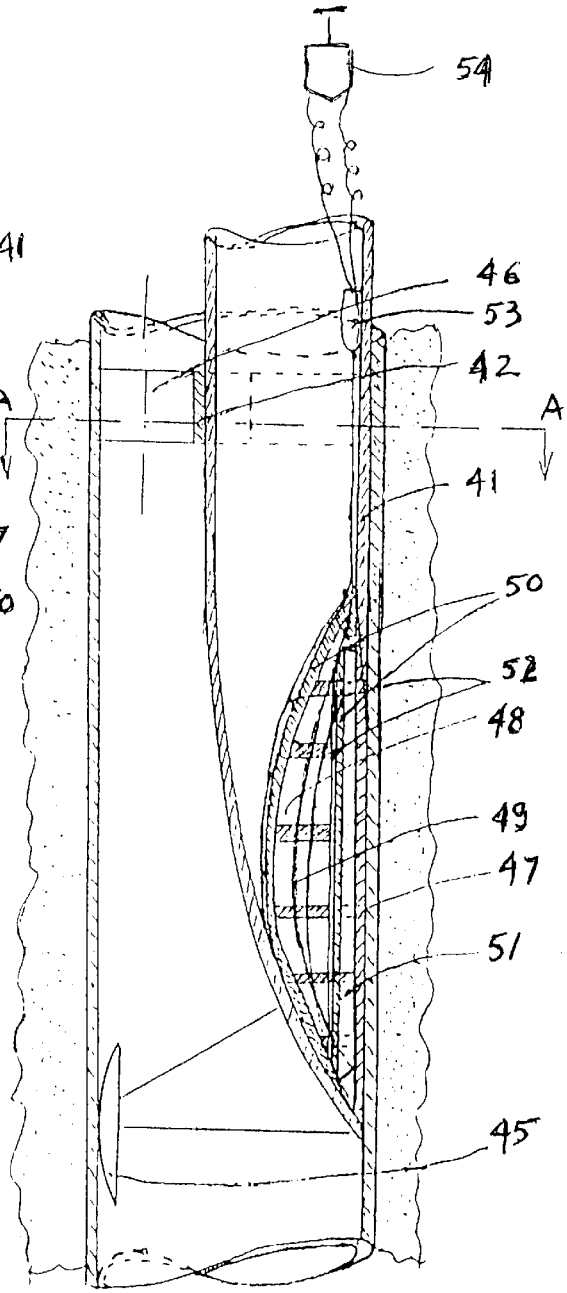
FIG. 9
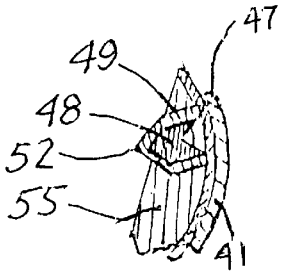
FIG. 9 BB

METHOD OF FABRICATION, TOOLING AND INSTALLATION OF DOWNHOLE SEALED CASING CONNECTORS FOR DRILLING AND COMPLETION OF MULTI-LATERAL WELLS

This invention relates to apparatus used for installation of downhole branch wells from a larger diameter well casing, to methods for fabricating the apparatus used to install the branch wells, and to methods for installing the pre-fabricated apparatus at a downhole location in a cased well.

Referenced U.S. Pat. No. 5,462,120, issued Oct. 31, 1995

FIELD OF INVENTION

Multi-lateral wells include a main cased well connected in one or more places to liner-equipped lateral holes of smaller diameter. For flexibility of operation of such wells and to prevent the pollution or adjacent aquifers by well fluids, it is necessary that the connection between casing and liners be leak-proof.

In order to facilitate drilling and completion of each lateral branch well, the kick-off angle of deviation between the lateral branch well and the main cased well is typically limited to a few degrees only. Correspondingly, the window in the main casing through which all deviated work strings and branch well tubulars are inserted during the drilling, logging and completion operations of each lateral well is an elongated ellipse of main axis greater than 10 ft, and with a short axis of only a few inches (the diameter of the lateral drill hole, which is smaller than the casing inside diameter).

When the elongated window is cut "in situ" from a pre-cemented well casing,using a known whipstock to guide the milling bit at the end of a drill string, the precision of the cut is rather poor, due to vibrations of the drill string. Vibrations may also damage the bond between cement and steel in the remaining part of the casing, opposite the window. Friction of the milling bit against the hard whipstock surface during this operation results in rapid wear of the bit and in a reduction of its diameter, contributing to irregularities in the window's contour.

These difficulties are overcome in U.S. Pat. No. 5,462,120, issued on Oct. 31, 1995, which makes use for the branch well of pre-fabricated fixed connector tubes, designated as curved channels or multi-channel whipstocks and of pre-fabricated movable connector tubes, designated as intermediate liner elements and as liner stubs, included in the main casing string, run-in prior to its cementation or in a tubular element (insert or patch) inserted into a pre-cemented casing from which a short segment (ca.20 ft-long) has previously been milled-out, by known methods.

Fixed connector tubes and channels remain within the casing and are each connected at their lower end to an accurately-cut window. They are run and installed in a borehole of constant diameter.

Movable connector tubes, which, ultimately, are connected at their upper end to the edge of a pre-fabricated window, on the contrary require for their installation that a cavity be under-reamed or drilled in the milled-out interval, over which these casing inserts or casing patches are installed. Their sealed-equipped movable connector tube internals are extended into the cavity, which is filled with cement slurry. The squeezed-in cement provides a reliable additional protection from any fluid leakage or entry at the branch well connection.

Finally, any protrusion from the movable connector tube into the casing, casing insert or casing patch is removed to restore full access to fluids and tools across the length of the windowed interval to the lower part of the casing.

When such an elongated window is cut in a steel tubular of wall thickness typically a quarter inch or less, the tube strength and the dimensional stability of the window are greatly reduced, thus making it difficult to achieve a scaled connection between the remaining part of the main casing and the lateral liner.

Relatively thin-wall steel tubulars made either by the known seamless extrusion methods or by the Electric Resistance Weld fabrication methods generally present residual stresses which, when applied to the machined surface of the elongated elliptical window, tend to distort it, also weakening these windowed tubular elements. Such distortion and structural weakening make it difficult to handle and seal these deformed windowed elements.

SUMMARY OF THE INVENTION

The present invention covers fabrication methods of such connector assemblies, which overcome the deformability of the elongated windows in casing joints, or in casing inserts and casing patches, and which restore the structural strength of these prefabricated elements.

The primary objective is to make all casing elements, including casing patches and casing inserts, and all liner elements, including curved channels, multi-channel whipstocks and straight liner elements, capable of withstanding handling by conventional lifting and drilling rig equipment without any damage to their seal surfaces.

A secondary objective is to accurately machine and cut the internal tubular connectors (curved channels, intermediate liners and liner stubs), which are to be sealed to the edge of said windows.

A tertiary objective is to reduce the installation time of these casing elements in existing cased wells, using appropriate downhole tools.

These objectives are achieved by:

1) restraining the wall of the well tubular element within a rigid tubular corset prior to and during the window cutting operation,
2) checking that such restraining forces have not reduced the drift diameter of the tubular element, by means of known caliper tools,
3) positioning, with respect to the completed window, the specified fixed or movable internal elements used as lateral connector tubes within said tubular element, checking their operability and sealing or welding capability
4) fastening the windowed well tubular element to fixed rigid internals within said tubular element. The rigid internals are used as stiffeners for structural re-inforcement and as permanent tool guides in said fixed lateral connectors or as removable guides for said movable lateral connectors, while said tubular element is restrained within said rigid corset, and until the windowed element is cemented in a borehole.
5) removing the rigid corset, for future re-use.

The present invention also covers:

a) shop tools for accurate machining of elongated windows, in tubular elements,
b) shop tools for machining seal grooves and end faces in lateral connector tubes, in liner stubs and in curved channels,
c) downhole tools for quicker removal of the segment of main casing over which a casing insert or a casing patch is to be installed, d) downhole tools for quicker installation of a pre-fabricated fixed lateral connector in a pre-cemented casing.

Further objects and features of the present invention will be readily apparent to those skilled in the art from appended drawings and specification illustrating a preferred embodiment.

BRIEF DESCRIPTION OF THE DRAWINGS

FIG. 1A is a perspective assembly view of the tubular corset applying restraining forces upon the outer surface of a casing element fully installed, together with a solid retrievable whipstock, within said corset.

FIG. 2 is a perspective view of the upper end of an intermediate liner element, with its guiding collar, pin and seal.

FIG. 3 is a perspective assembly view of the corset of FIG. 1 equipped with a set of guiding rails in a slanted "A" frame.

FIG. 3A is a perspective view of a threaded drillable fastener used to transfer the restraining forces from the outer corset to a drillable rod-type internal assembly, used as temporary stiffening means.

FIG. 6 is a vertical cross section of the double sliding cage used to guide the liner stub within the drillable rod stiffener assembly and through the casing window.

FIG. 6A is a transverse cross section, taken in the AA Plane of FIG. 6, of the double sliding cage used as movable guide and support of the liner stub.

FIG. 8 is a schematic axial cross section of a downhole tool used to vertically slit the casing segment into strips and to remove the casing strips, showing the arms in the retracted position.

FIG. 8A is the same cross section with the arms in the extended position.

FIG. 8AA is a transverse cross section of the plow arm taken in the plane AA of FIG. 8.

FIG. 8BB is a transverse cross section of the cutting wheels in their retracted position, taken in the plane DD of FIG. 8.

FIG. 8B is a vertical cross section of a combined grinding wheel and turbo-expander wheel driven by high pressure fluid conveyed through one of the cutting arms of an improved slot-cutter tool.

FIG. 8C is a sectional view taken in the plane BB of FIG. 8B.

FIG. 9 is a vertical cross-section of a cemented cased well in which a single fixed tubular connector has been installed.

FIG. 9AA is a transverse sectional view of a pre-fabricated fixed connector tube assembly, including means for its rapid installation in a cemented cased well, taken in Plane AA.

FIG. 9B is the back view of the cover plate of the connector tube prior to its inclusion in the connector tube assembly.

FIG. 9BB is a sectional view of the edge of the cover plate, taken through Plane BB, showing the right side of the shaped charge ring and the tie rib affixed to the cover plate.

DETAILED DESCRIPTION OF THE INVENTION

Figure 1:
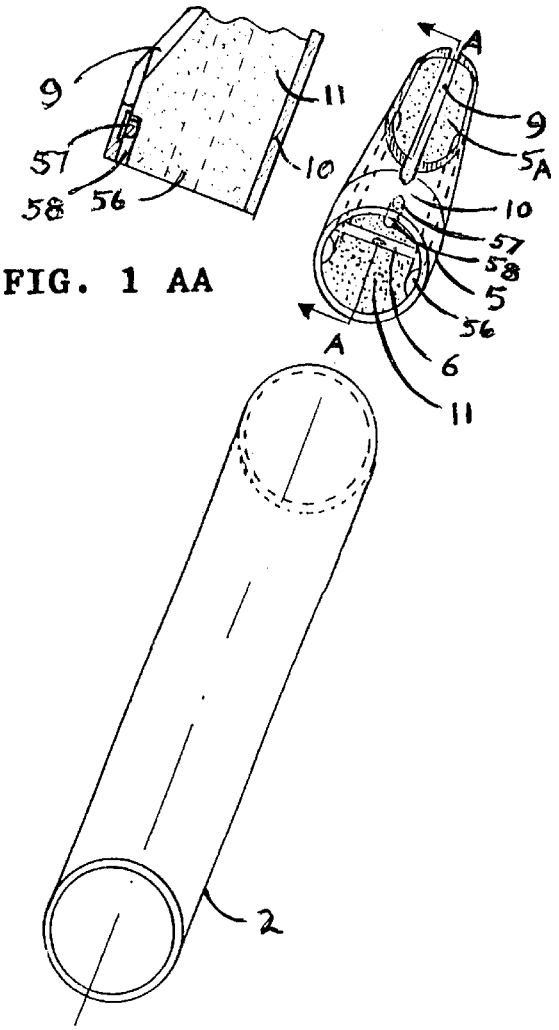
FIG. 1 is an exploded view of the tubular corset, casing element and a fixed whipstock-type internal stiffener.
Figure 1:
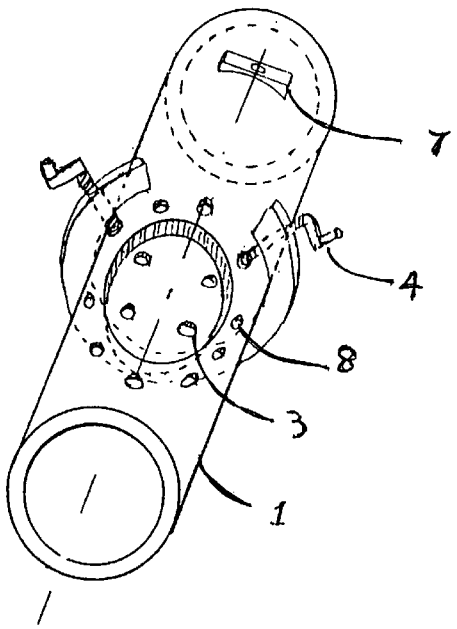

The conventional method of cutting a window in a well casing is to affix to the inner wall of a cemented casing a wedge-shaped whipstock made of hard metal, so as to force the milling bit, mounted at the end of a long tubular shaft (typically a drill string) and inserted inside the casing, to press against the inner wall surface of the casing and to cut the casing until the milling tool exits out of the casing. This operation is difficult to control in a well and even in a shop, because of vibrations, and the milling tool quickly wears out due to its friction against the hard whipstock surface.

Furthermore, the partially-windowed casing tends to swell out under the residual tensile stresses within the casing wall and the outwards force applied on the milling bit.

Any movable branch-well connectors, equipped with seals at their upper end, might get stuck during their extension through a deformed window and their seals might be damaged or made ineffective.

Unless large compressive restraining farces are permanently applied on the outer surface of the casing outside the area of the window, to maintain constant the tube diameter during and after the machining operation, the window's shape will not meet this narrow specifications required for making a tight seal between the window's edge and any slanted movable connector tube (intermediate liner element or liner stub, as called in the referenced Patent).

In fixed branch-well connectors of the referenced U.S. Pat. No. 5,462,120, curved channels or multi-channel whipstocks are internals which remain permanently within the casing element. They are welded at their lower end to the completed window's edge, while their upper end, equipped with a thick welded plate, may slide within the casing element. Each such curved channel or multi-channel whipstock, permanently installed within the casing element prior to the removal of the corset, thus acts as a stiffener providing permanent re-inforcement to the windowed casing during its handling by the drilling rig and during its installation in the well.

The quality of the sealing weld between the lower end of a curved channel or multi-channel whipstock and the window's edge is also greatly enhanced by accurate machining and positioning of at least one of the surfaces which are ultimately welded together in branch-well fixed connectors of the referenced Patent.

In accord with the present invention, cutting of an accurate and consistent window, or of a template thereof, is always done in a shop before the casing tubular element is placed in a well, either as a special casing joint, or as a casing patch, or as a casing insert.

The cutting of the window is carefully checked to assure that alignment is accurate. When the window has been cut, pre-fabricated internal assemblies are accurately positioned within the windowed casing element and the connector assemblies and guides are securely fastened in place. They provide re-inforcement of the windowed tubular casing element, as permanent or temporary stiffeners, until said element is fully installed in a well.

In movable branch-well connectors, the retrievable whipstock used for guiding the intermediate liner element through the milled-out window, or the guiding assembly with its liner stub in the retracted position, temporarily provide the same stiffener re-inforcing function until the slanted movable connector tube is extended out of the window, sealed in the casing and cemented in the formation Existing cemented cased wells may be of diameter too small to allow the use of a pre-assembled casing insert or casing patch, including all its internals, but large enough for a fixed branch-well connector. A method of pre-fabricating such curved channel or multi-channel whipstock assemblies is described, together with its time-saving field installation method. Said fixed branch-well connector later provides structural re-inforcement of the windowed casing, independent of the cement quality.

In a first embodiment (FIG. 1 and FIG. 1A), the said compressive forces are applied by a rigid steel corset 1 placed around the casing 2, prior to the start of the window-cutting operation. The tubular corset presents a window 3 of dimensions slightly larger than those of the required casing window and adjustable contact devices 4 for transmitting the restraining forces from the corset to the outer surface of the casing element placed within it. Excessive restraining forces are prevented by checking the drift diameter of the casing element with a known caliper tool.

The wedge surface 5 of a whipstock in the casing and the window in the corset outside it must be located so as to face each other. This is accomplished by placing on both the whipstock 5 and corset 1 a suitable orientation device or bubble level 6.

For instance, with the casing element horizontally supported, the bubble-type level indicator 6 affixed to the whipstock may be used to determine that the wedge face is in a reference plane (vertical or horizontal) and a similar level indicator 7 affixed to the corset is used to determine that its window is in a parallel reference plane. The axial distances from one of the casing ends respectively to the whipstock and to the corset window are also measured by known methods to insure that both are in the required positions for window machining. The restraining force devices are then firmly applied to the casing's outer surface. Template holes 8 in the corset are then used to drill holes through the casing wall and to tap into the lateral surface of the whipstock, so that the corset and the whipstock may be solidly bolted together through the casing wall.

The shop milling tool 12, mounted on its long tubular shaft is inserted into the casing element and gradually pushed against the whipstock wedge while the milling bit is rotated. Cooling of the milling bit is by a circulation of fluid through the shaft and return via the casing-shaft annulus. Additional coolant may also be added on the outer surface of the casing through the corset window, if necessary.

When the window has been cut in the casing element, the bolts affixing the corset to the whipstock through the un-tapped casing wall holes are removed, one by one and immediately replaced by screws 59 (FIG. 3A) made of drillable metal, which solidly fasten the casing wall to the lateral surface of the whipstock, but leave the corset disconnected from the casing wall.

Besides its normally known function of guide for the shop milling tool, during the window-cutting operation, the whipstock assembly also provides the function of re-inforcement, as a stiffener of the windowed casing, which is the main focus of the present invention, but it must also provide other functions required during the subsequent installation of the casing element and of its slanted tubular connector in a well.

The whipstock also provides a channel to be used as by-pass flow path for a cement slurry later injected in the part of the casing string located below the window to reach the casing shoe.

Finally, the whipstock is used to guide and seal the slanted movable connector tube (intermediate liner) through the window and then to guide drill strings and branch well tubulars through the connector tube during the drilling and completion phases of the lateral well.

The whipstock, as prescribed in U.S. Pat. No. 5,462,120, for such additional guiding functions downhole, is thus equipped with an orientation groove 9 in the middle of its wedge surface.

Figures 1A, 1B:
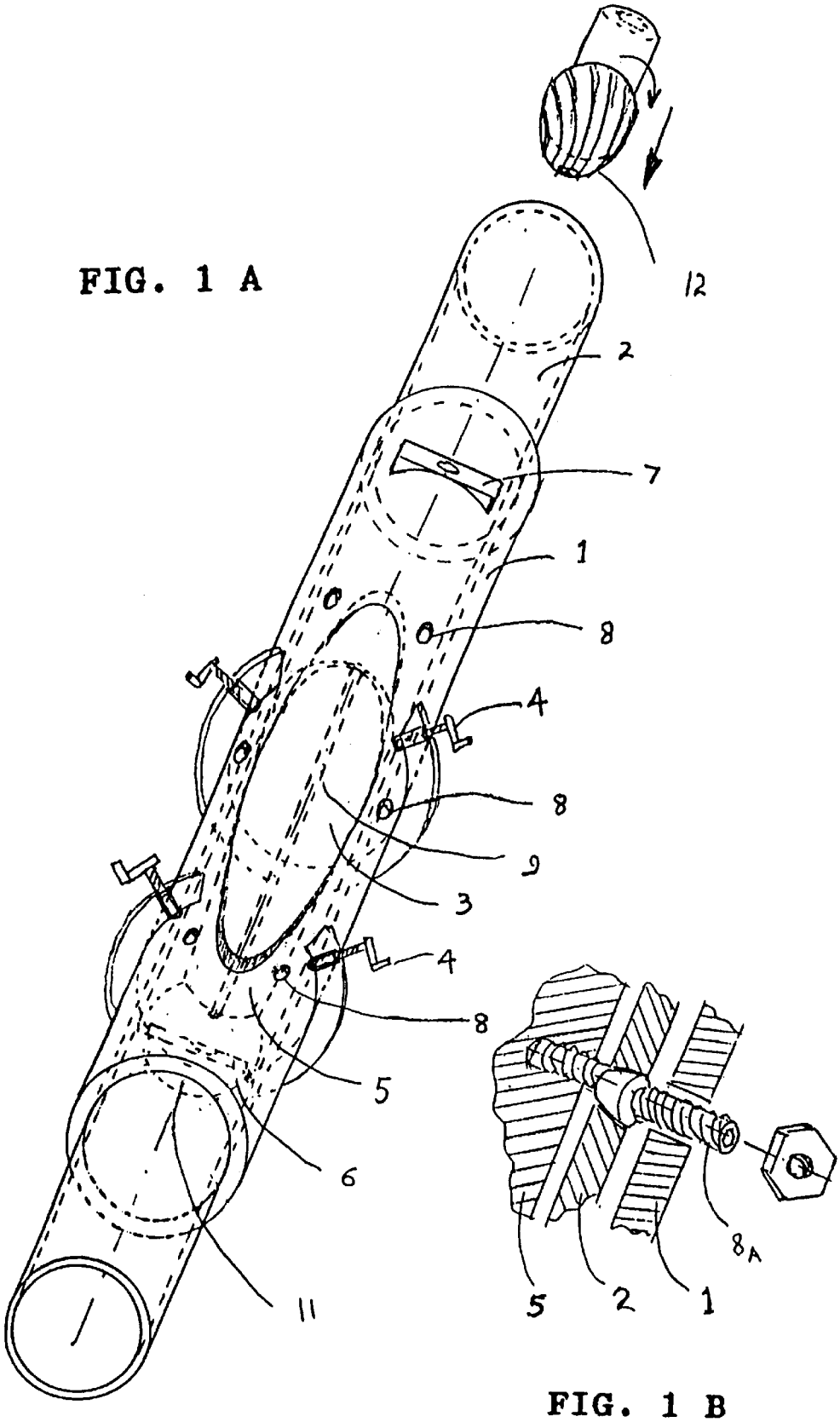
FIG. 1AA is a profile sectional view, at an enlarged scale, of the lower part of the whipstock assembly, taken in the plane of symmetry AA of FIG. 1. It shows a pin and groove system of anti-rotation of the whipstock core of FIG. 1 and the orientation groove of the liner collar of FIG. 2.
FIG. 1B is a perspective view of threaded fastening means to transfer the restraining forces from the outer corset to an internal whipstock-type assembly, used as a temporary stiffener.

The whipstock may be made of one piece of metal, of smaller diameter than the casing element inside diameter, with a machined or cast central groove, as in FIG. 1A. If so, it is preferably designed to be retrievable with a wash-over cutting tool, as indicated in the referenced Patent.

If, however, the hard wedge surface of a full-bore whipstock is limited to that of the wall of a thick tube 10, as in FIG. 1 for a permanent whipstock, the inner part of the whipstock is filled with an inner core 11, made of drillable material, in which the specified central orientation groove 9, or a guiding strip, has been machined or molded. Its wedge surface, 5A, matches that of the tubular whipstock and its lateral surface is fastened or bonded to the inner surface of the tubular whipstock or connected to it through a known pin and groove rotation-preventer system.

It will be apparent to those skilled in the Art that, if the anti-rotation groove 58 is located in the inner surface of the tubular whipstock 10, the matching pin 57 will be located on the outer surface of the inner core whipstock 11. Conversely, if the anti-rotation groove 58 is located in the core whipstock 11, the matching pin 57 will be affixed to the inner surface of the tubular whipstock 10. In that case, it will be made of drillable material, to be drilled out at the same time as the core whipstock.

Similarly, larger additional grooves 56 in the lateral surface of the inner core 11, or a tubular channel in the interior of said core, may provide flow paths to the cement slurry through the whipstock assembly to a casing cementing shoe, below, if the core whipstock is installed within the tubular whipstock prior to, rather than after the casing cementation.

All those various options, and their combinations are included the present invention.

Figure 4:
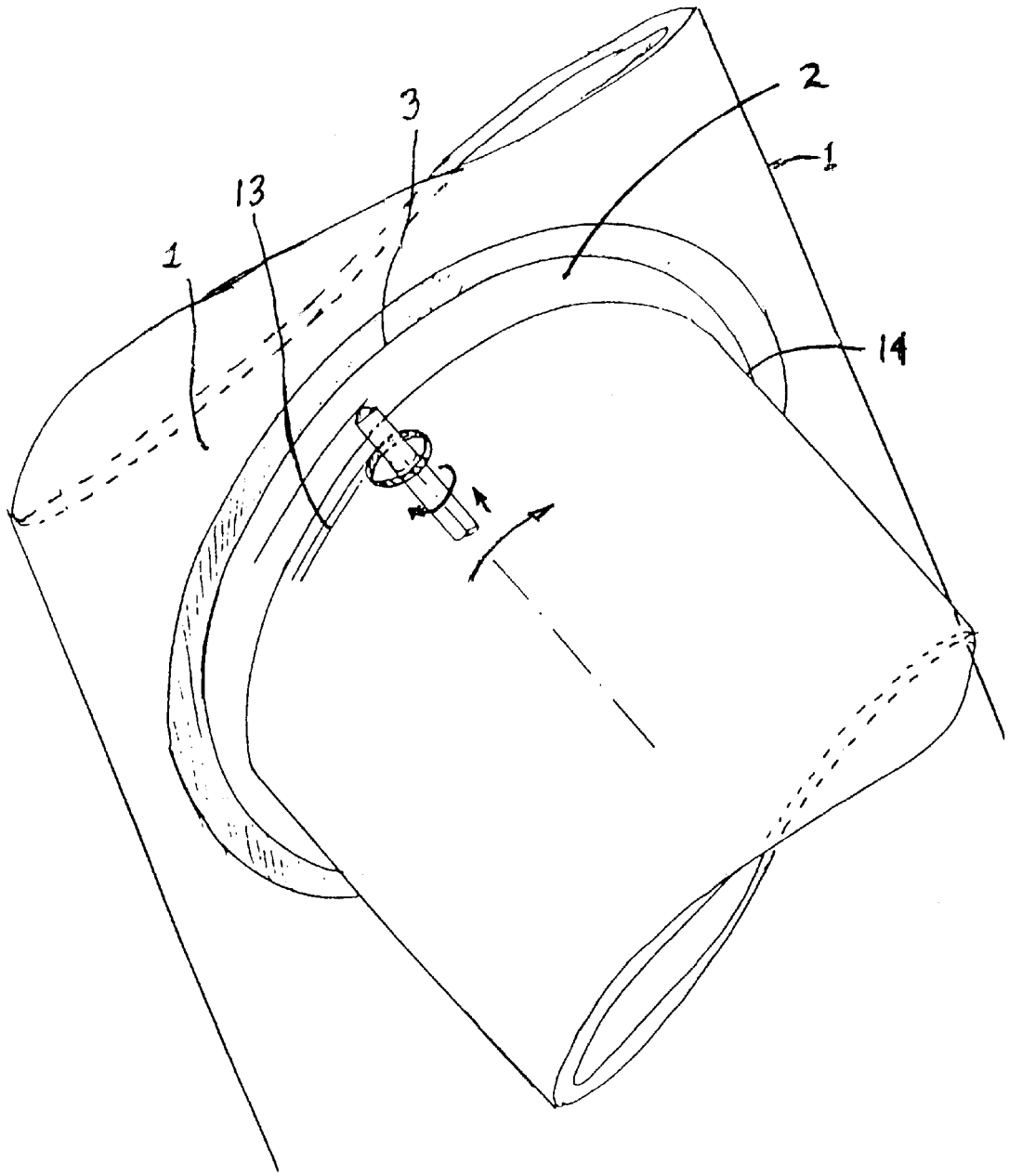
FIG. 4 is a perspective view of a shop tool used for machining a seal groove on the outer surface of a movable connector tube and for machining the end faces of all branch-well connector tubes, also designated as curved channels, multi-channel whipstocks, intermediate liner elements and liner stubs.

The intermediate liner element, 43, shown in FIG. 2, must easily be insertable through the window 3, with sufficient clearance for its specified sealing element. If not, minor grinding adjustments are made along the window's edge to achieve proper clearances. The upper end of the intermediate liner element is traced along the edge of the window. An "O" ring groove 13 is then machined on the outer surface 14 of the intermediate liner element at a short distance from its traced upper end. The milling tool used for this task is guided respectively by the edge of the corset window, by the casing outer surface and by its rotation around the axis of the intermediate liner element. This cutting tool is shown on FIG. 4. Its axis is parallel to the axis of the intermediate liner element. A similar tool, equipped with a different milling bit is later used to cut the upper end-face of the intermediate liner element, along its trace.

A guiding collar 15 made of drillable metal is fastened to the upper end of the intermediate liner and an elastomeric "O" ring type seal is placed around the upper end the steel liner, in the outer surface groove behind the drillable guiding collar.

The lower part of the drillable guiding collar, which will slide into the whipstock groove, presents a guide pin, extrusion or indentation 16 of shape matching that of the profile of the whipstock groove or strip 9.

The lower end of the intermediate liner element is plugged-off with drillable material 17.

The corset is then removed, for re-use in the fabrication of additional windowed casing elements of same diameter and same kick-off angle.

A drillable cover plate 30 is affixed to the window's edge using drillable fasteners. The cover plate presents transversal parallel tie ribs 55, which materialize the dual curvature, in space, of the window's edge.

In large-diameter casings, where fixed multi-channel whipstocks may be used as branch-well connectors, as taught in FIG. 1 of the referenced Patent, instead of the movable intermediate liner, 43, the whipstock is permanently affixed inside the casing element, while the casing is held in the corset 1. In that case, a window is cut by the shop milling tool opposite the bottom end of each channel in the multi-channel window, by the method of the first embodiment.

The greatly weakened multi-windowed casing is then re-inforced by welding directly the bottom end of each channel in the whipstock to its corresponding window in the casing element, along their respective edges, using known welding methods, prior to the removal of the corset.

The multi-channel whipstock also provides an additional vertical by-pass flow path to convey a cement slurry to the casing space below the lowest window.

As in the first embodiment, a drillable plate 30 is then affixed to the edge of each window, without damaging the welds and each channel is plugged off with drillable material. The drillable cover plate is stiffened by transverse tie ribs 55, which may be cast in place on the plate or separately machined and affixed to the bent plate covering and sealing surface.

It will be apparent to those skilled in the art that the method of the first embodiment, combined with known welding techniques, is directly applicable to the shop fabrication of casing elements including fixed multi-channel whipstocks, which, in this case, are permanently installed and do not require drillable fasteners.

In a second embodiment (FIG. 3), the windowed tubular corset 1 is equipped with rail guides 18 on a rigid steel "A" frame 19, at the specified kick-off angle, corresponding to the window's dimensions. The function of the rails is the same as that of the internal whipstock wedge surface in the FIG. 1 embodiment, but, being located outside of the casing elememt they provide more direct control of the machining operation. For this purpose, the corset is affixed only to the casing wall by means of double-ended bolts (FIG. 3A) which have one end threaded into the casing wall and the other end inserted in the corset hole 8 and bolted against the outer surface of the corset 1.

These bolts, required only during the window-cutting operation, are later replaced, one by one, by drillable screws threaded, both through the casing wall and into the outer lateral surface of a retrievable whipstock assembly, used again in part for its important function of re-inforcement and stiffening of the windowed casing element, prior to its cementation into a well.

The shop milling tool 12, which no longer requires a long shaft, is guided by the rails 18 rather than by a whipstock. It starts cutting the window from the end of the window's long axis opposite from that shown on the FIG. 1 embodiment. It also advances inwards into the casing element rather than outwards.

This new disposition improves the window machining accuracy and reduces wear of the milling bit, while providing a better control of the bit advance, lubrication and cooling.

It also allows the use of a wider variety of cutting tools, both mechanical and thermal (Oxygen Plasma, Laser and Electron beam), which otherwise, could not be guided from the inside of the casing, by a whipstock. It will be apparent to those skilled in the Art that these various cutting tools may be used in multi-pass and/or in combination to obtain an accurate, undistorted window's edge, which may also be precisely beveled or grooved, despite its great length and narrow width.

The whipstock assembly's other functions, after the tubular element has been lowered into a well, are then only limited to:

1) conveying the cement slurry to the casing space below the window, via a by-pass fluid flow channel,
2) guiding the drill bit which will simultaneously cut into the drillable cover plate of the window and drill the lateral drainhole,
3) orienting, by means of the whipstock's central groove, the guiding collar at the intermediate liner upper end,
4) guiding tubular strings into the lateral branch well.

These tasks are less demanding than those of cutting a window the steel casing, so that the whipstock may be made, in part or in whole, of drillable material.

To satisfy task No.1, the cement slurry may be conveyed either through a channel within the whipstock or through channels between it periphery and the inner wall of the casing element. To satisfy task No.3, a central groove 9 or strip is required in the whipstock for orienting the guiding collar during its extension through the window.

For instance, the outer cylindrical surface of the re-inforcing whipstock assembly may be made of a drillable metal tube, with a co-axial hard metal whipstock fastened inside it. When the inner whipstock is of the tubular kind, it may then be removed from the well by drilling out the outer tube with a known coring bit after cementation of the casing element. This restores the casing element to its full inside bore diameter.

If the drainhole is drilled in hard formations, however, the use of a hanger-supported solid whipstock of reduced diameter, made of a hard core, but retrievable with an overshot cutting tool, as describe in the referenced Patent, may be more advantageous. In that case, the cement slurry may be conveyed through the annulus between the inner surface of the casing and the lateral surface of the reduced diameter solid whipstock. The temporary re-inforcing function of the whipstock is achieved by the drillable screws 59 fastening the whipstock to the casing wall, which are subsequently cut in the well by the overshot cutting tool.

Another alternative whipstock for that case is a full-diameter whipstock, affixed to the casing element by means of drillable fasteners and composed of a drillable outer tubular shell re-inforcing internal, affixed to an oriented retrievable central hard core. The cost of the whipstock support, a conventional oriented drillable hanger/packer, may thus be eliminated.

These various types of whipstocks, performing the same multiple functions, are variants of the present invention, The second method of window-cutting thus allows the use of any type of whipstock, solid or tubular, in one or two pieces, permanent or retrievable. It is the preferred embodiment.

In a third embodiment, the fabrication of casing elements equipped with telescopically-extensible liner stubs, the window machining operation is the same as that in the second (FIG. 3) embodiment. The same type of corset 1, equipped with parallel rail surfaces 18 on a rigid "A" frame 19, is used. No whipstock, however, is used in this device. It is replaced, as a windowed casing re-inforcement, by a pre-fabricated telescopic stub internal stiffener assembly.

Figures 5, 5A:
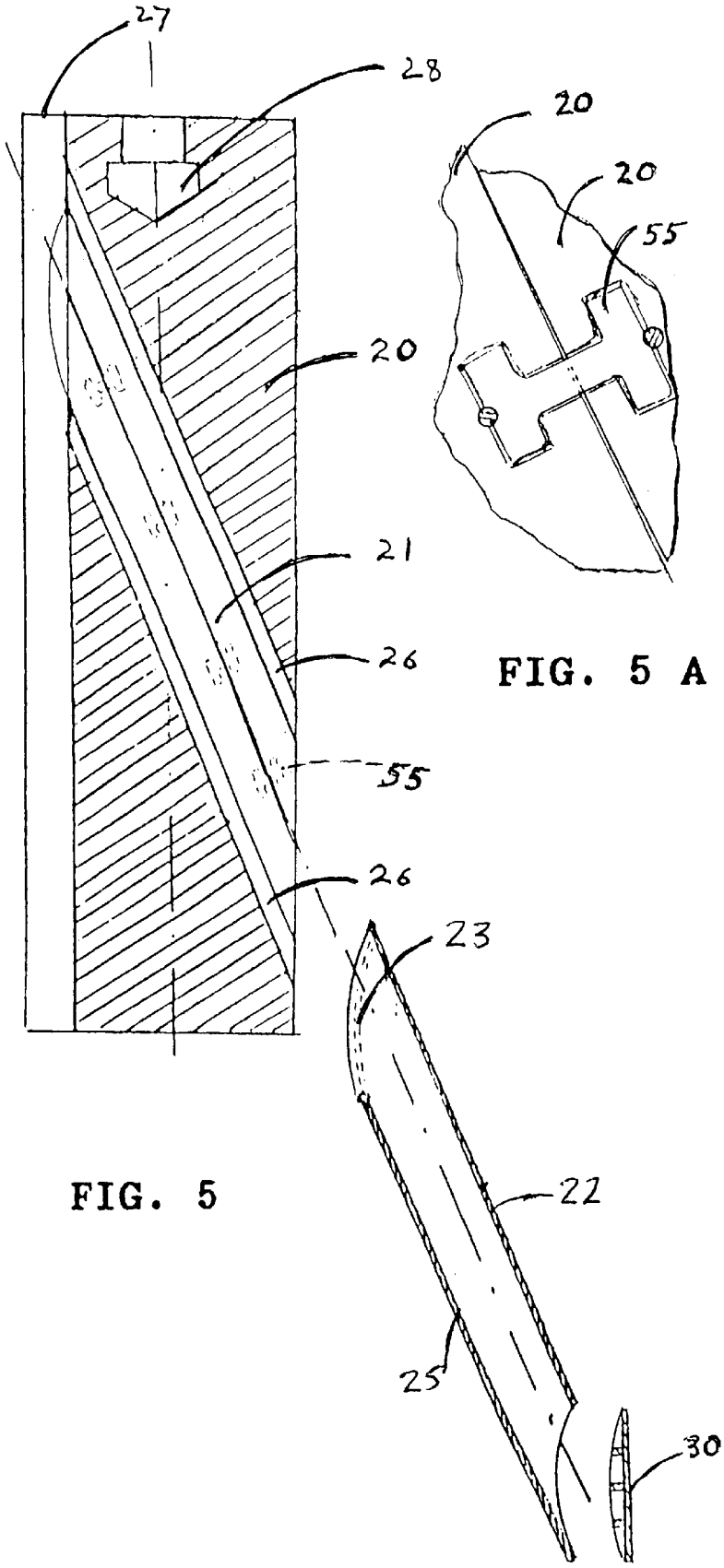
FIG. 5 is a vertical cross section of the drillable rod stiffener assembly showing its various cavities and showing in an exploded sectional view the liner stub and its end cover plate, prior to their insertion into the rod's main cavity.
FIG. 5A is perspective view of a drillable fastener of the two halves of the rod stiffener assembly.

A pre-fabricated insert drillable guiding assembly containing all the elements specified in the referenced Patent is separately assembled from pre-fabricated parts, (FIG. 5) including:

1) a solid cylindrical rod 20 of drillable material of diameter equal to the drift diameter of the casing element, in which five or more cavities 21 have been machined or cast. This part is an assembly designed to present sufficient stiffness and structural strength to transfer to the windowed casing element all the restraining forces previously applied by the outside corset 1. The cylindrical rod assembly is made of two halves, solidly affixed together by drillable fastening means, across the transverse diametrical plane of its main cavity, slanted at the kick-off angle, as shown in FIG. 5 and FIG. 5A.
2) a steel liner stub 22 equipped with a drillable guiding collar 15 and seal 23 at its upper end, but in which the lower end is left unplugged, located within the main cavity 21 of the rod, in the shape of a cylinder of diameter slightly larger than the short axis of the liner stub collar and slanted at the specified kick-off angle from the rod axis; (its pre-fabrication is made by the same methods and tools than that of intermediate liner elements, except that its lower end is also cut parallel to its upper end, as shown on FIG. 5)
3) a combination of two drillable co-axial guide cages 24, respectively sliding within the rod assembly (FIG. 6) and internally within the liner stub 22 to support it during its extension out of the casing.

A transverse section of the double cage 24 is shown on FIG. 6*a*. The inner cage 25 has a cross-shaped beam section providing maximum stiffness to support the effective weight of the liner stub during its extension.

The cavities in the fixed drillable rod sub-assembly, besides the main slanted cylindrical cavity 21, include:

a) slanted cavities 26 parallel to the axis of the main cavity 21, in the shape of lateral grooves machined or cast in the cylindrical rod, in two or more radial planes of the main cavity, in which the short bars of the outer guiding cage 24 will slide,
b) a vertical by-pass channel 27 in the rod, with a horizontal cross section in the shape of a portion of a circle of diameter equal to the inside diameter of the casing element,
c) a central cylindrical blind cavity 28 on the top surface of the upper half of the rod assembly, equipped with one or more lateral grooves matching the dogs of a known fishing tool.

After the installation and cementing of the telescopic liner stub in a well, the drillable rod sub-assembly will be drilled-out in two stages, first with an overshot cutting tool of length sufficient for its cutting edge to reach slightly below the center of the casing window cutout. In this cutting operation, all the upper fasteners on the upper half of the lateral surface of the rod sub-assembly are milled out and all the fastening means connecting the two halves of the rod are also removed.This allows the easy removal of the upper half of the rod and of the guiding double cage attached to it, by inserting a fishing tool into the top cavity of the rod, thus fastening it to the wash-over tool or to its work string. Pulling out the tool's work string removes the upper half of the rod sub-assembly and both guide cages to clear the window's opening, thus leaving only the lower half of the rod to later serve as a drillable wedge for guiding the drill string and liner string into the extended liner stub. The remaining lower part of the rod will only be drilled-out after the installation of all permanent tubulars in the lateral well. During this second drilling operation, any protrusion within the casing is also removed. The resulting full-bore casing element then allows the installation of additional laterals below the first one, at a later date, if required.

Returning to the method of pre-fabrication, in the shop, of a sealed branch connector of the type including a telescopic stub, the operations proceed as follows:

When the casing window cutout 3 has been machined, adjusted and tested for conformance with specified dimensions, the prefabricated guiding assembly, including the rod assembly, with its twin guiding grooves and cavities, plus the sliding double cage guide and liner stub, is inserted into the casing element.

The unplugged lower end of the liner stub 22 is lined-up against the casing window and pulled out through it to check that the liner stub is effectively free to extend out of the casing.

The liner stub is then thrust back into the casing element and fastened to the guide cage 25 by means of calibrated shearable fasteners 29, installed through the open bottom end of the stub.

Transverse tie ribs, made of drillable metal, are affixed by drillable fasteners to the edges of the stub's lower end.

A drillable end plug 30 is then fitted into the lower end of the stub and affixed to the tie ribs by drillable fastening means.

The double-ended bolts of the corset are then removed and replaced, one by one, by drillable screws 59 tapped into the lateral surface of the rod assembly, thus transferring the restraining forces from the corset to the rod, which is substitued, for this purpose, to the whipstock used in the second embodiment.

This is the last step of fabrication of a casing element with a single telescopic stub. If the length of the casing element is sufficient to accept two stubs and if their relative orientation is known, a second window is machined in the casing by the same method, in the area not filled by the previous guiding assembly. A second guiding assembly is assembled from additional prefabricated parts. It is then inserted into the casing element, tested and installed in the same way as the first one. This completes the fabrication of casing elements of the type shown on FIG. 4 of the referenced Patent.

Figure 4A:
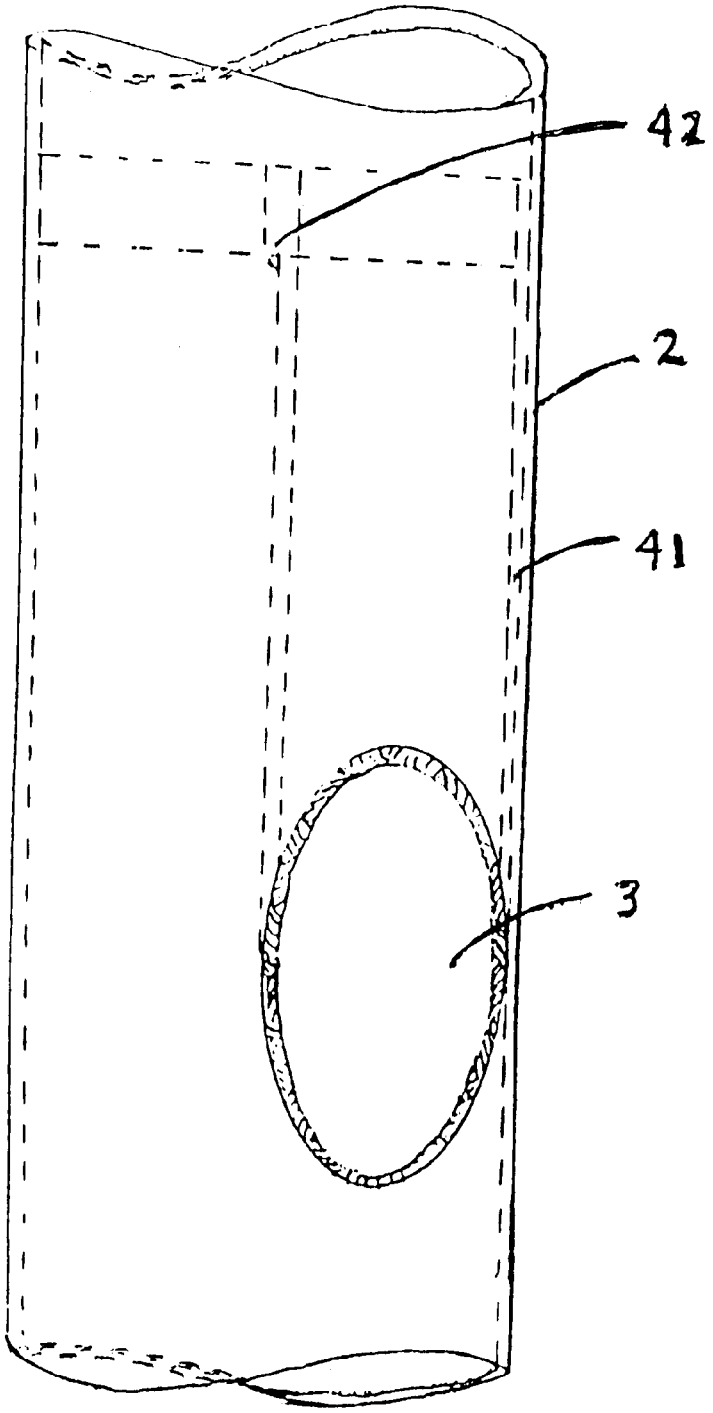
FIG. 4A is a perspective view of the weld between a fixed curved channel connector's lower end and the casing window's edge.

In a fourth embodiment, the fabrication of casing elements equipped with fixed connector tubes,such as curved channels, is shown on FIG. 4A. The window machining operation is also the same as that in the FIG. 3 embodiment. The same type of corset 1 equipped with rail 18 on a rigid "A" frame 19 is used. The re-inforcement of the windowed casing is, in this case, provided by a curved channel of diameter slightly less than-that of the short axis of the window 3 and of radius of curvature equal to that of the future branch well, typically about 300 ft, starting about 5 ft from the upper end of the channel.

The curved channel 41 is made by bending a steel pipe in a pipe-bending machine to the required specification. It is then inserted from the outside, through the casing window 3, into the upper part of the casing element, still held within the corset. It is thrust until its straight end emerges from the upper end of the casing element.

A thick steel end plate 42 of outside diameter slighly smaller than the drift diameter of the casing is then tangentially welded to the periphery of the straight end of the curved channel and thrust back into the casing. The machined end plate presents one or more holes, which provide access to fluids and tools within the casing, along the curved channel and below the window. The lower end of the curved channel is then traced along the casing window's edge and bevel using the millimg tool of FIG. 4.

The casing window's edge and the beveled lower end of the curve channel are welded together by known methods, such as multi-pass electrical MIG, TIG or plasma welding. The weld bead, along the window's edge is made up of short segments welded alternatively on one end of a radius of the window and then at the end of the opposite radius, so as to minimize thermal distortion and residual stresses in the sealing weld bead.

The curved channel 41, in tangential contact with the inside surface of the casing, with its lower end welded to the window's edge and with is upper end guided by the end plate, provides the required stiffening to the windowed casing. The adjacent holes in the end plate provide the required access to the casing below the window for tools of diameter as large as one half of the casing inside diameter.

Typically, an 11.75" OD casing element, of same diameter as the API couplings in a 10.75"OD casing string, may provide space for two 5"ID curved channels, each one permanently welded to a window 3, while still leaving enough by-pass space to convey a cement slurry to the casing shoe, below the twin curved channels.

Figure 7:
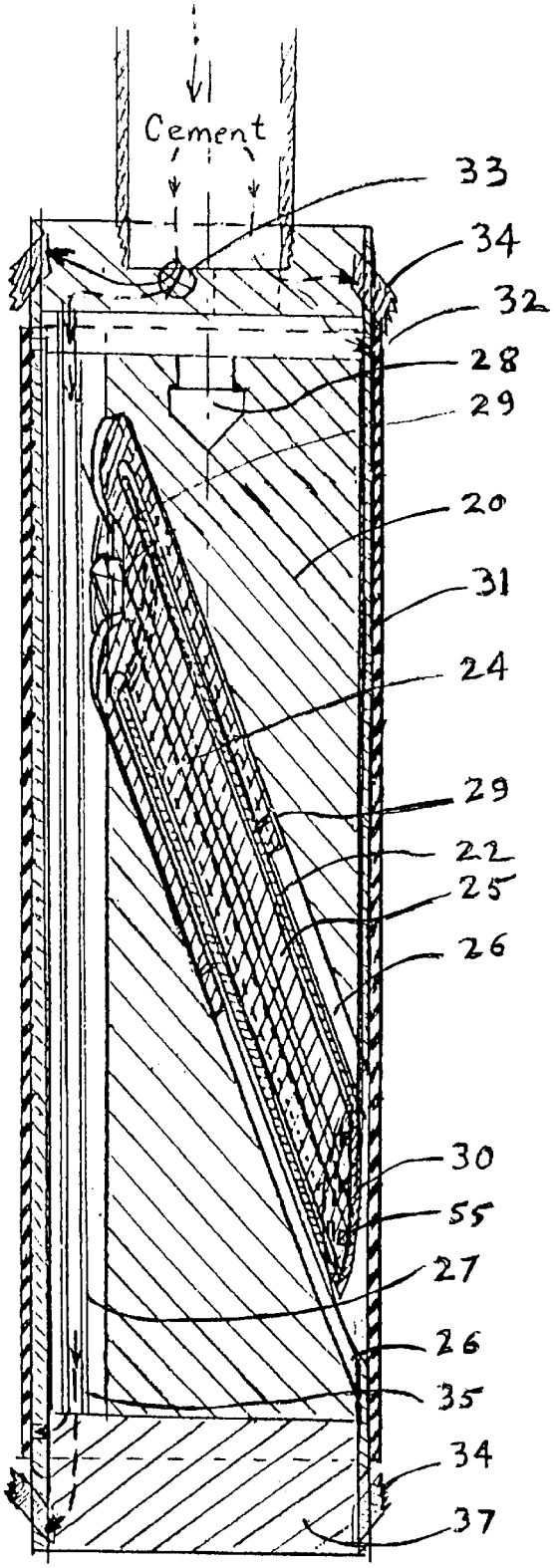
FIG. 7 is a vertical cross section of a rubber-covered casing insert including all its internals.

In a fifth embodiment, the method of fabrication of embodiment No.3 is applied to the construction of casing inserts for the type of connector shown on FIG. 10 of the referenced Patent. The diameter of the casing insert does not exceed the drift diameter of the cemented casing in which it is to be installed, but the first steps of its fabrication are identical with those of the third embodiment for a casing element. The dimensions of the required corset, milling bit and guiding assembly may, however, be different. The completely fabricated insert is shown on FIG. 7.

Upon removal of the corset, a tubular rubber sleeve 31 is slipped over the central part of the insert, covering the window, the plugged lower end of the liner stub, and at least one port hole 32 drilled into the top end of the insert wall, to provide entry of the cement slurry into the annulus space between the outer surface of the insert and the inner surface of the elastomeric sleeve 31.

This entry port hole 32 is then placed in flow communication with a known valve-type device 33 made of drillable material and providing control of the flow of cement slurry from a work string into the annular space inside the rubber tube.

A known hydraulically-controlled hanger device 34 is then fitted to the bottom end of the insert. The pistons extending the dogs in this known hanger device are operated by a drillable hydraulic line 35 threaded from the top of the insert through the cut-out channel 27 in the rod assembly 20 of the guiding assembly to the bottom hanger 34.

Another known hydraulically-controlled hanger device 36 is affixed to the top end of the casing insert and both devices are hydraulically connected with the work string, so that the two hangers are both simultaneously operated by a pressure increase of the fluid in the work string.

A drillable or retrievable plug 37 is also affixed to the bottom end of the casing insert, to fully enclose the space covered by the rubber sleeve, during its extension into the well's reamed cavity.

The top and bottom ends of the rubber sleeve are then bonded to the insert's outer surface and closed with straps.

This last step completes the fabrication of the casing insert.

In a sixth embodiment of the invention, the fabrication of a casing patch of the type shown on FIG. 11 of the referenced Patent proceeds through the steps of embodiments 1 or 2 using a whipstock presenting a vertical hole, so that fluid pressure from the work string, to which the top end of the patch will be connected, may be transmitted below the whipstock.

Known hydraulic hangers are then affixed to both ends of the patch. A drillable plug is affixed to the bottom end of the patch, thus enclosing the fluid in the work string, as in the previous embodiment.

This last step completes the fabrication of the casing patch equipped with a movable connector assembly.

The installation of a casing insert or of a casing patch in an existing cemented casing requires the prior removal of a casing segment of length equal to or greater than that of their respective windows. With conventional milling bits at the end of a rotary work string, this preparation may be time-consuming.

A less costly alternative method consists in using a combination of known tube cutting methods with the use of a downhole tool derived from that of FIG. 2*c* of the referenced Patent.

In a first stage, two circular cuts of the main casing are made, at the top and bottom of the segment to be removed. Known tools such as wireline-operated explosive casing cutters or tubing-conveyed chemical cutters may be used for this task. These cutting operations are preferably performed above a known retrievable plug, so as to protect the lower part of the cemented casing string and to catch any debris.

For the quick removal of the cut casing segment, a downhole tool derived from that of FIG. 2*c* of the referenced Patent is used for cutting the casing segment into vertical strips which are then pried loose from their underlying cement layer. The resulting long steel strips drop down on top of the retrievable casing plug. They are then picked up by known magnetized fishing tools mounted preferably at the end of a wireline, used in a subsequent run to retrieve the casing plug.

The modified downhole tool is shown schematically on FIG. 8. It is run on a high-pressure work string, used to convey a hydraulic fluid (such as water or compressed gas) required for the tool's operation.

The cutting arms are hydraulically pressed into the inner casing surface,just above the lower circular cut, thus initiating a slot. The work string is then pulled up from the surface. Multiple arms equipped with plows 38 instead of slot-cutting wheels, but located in the same axial plane and a short distance below the wheels are also in their extended position.

They enter into the slots at their contact with the lower circular cut to lift the slot edges off the underlying cement sheath. Each slot is terminated by closure of the cutting arms when the depth of the upper circular cut is reached. The lifted vertical strips drop on top of the plug, where they are later picked-up by known magnetized junk recovery tools. A transverse sectional view of the plow 38 is shown on FIG. 8A.

In a variant of this combined slot-cutting and plowing tool, shown on FIG. 8B, the sides of the cutting wheels 39 are machined like radial expander turbine wheels. A slip stream of hydraulic fluid, preferably compressed gas, is conveyed through the fork 40 in each cutting arm to the turbine inlet, resulting in high speed rotation of the wheel, the outer edges of which are covered with abrasive particles 44, such as Tungsten carbide. In that case, the wheel operates as a grinder rather than a punch, which reduces the required hydraulic pressure, and yet results in high cutting speeds. The turbine exhaust is into the casing fluid, with return to the surface.

A vertical sectional view of the turbine and grinding wheel is shown on FIG. 8C.

In existing cemented cased wells of diameter too small to accept more than one branch lateral, typically with a 7"OD casing, but where the addition to the existing vertical well of a single 4"OD branch-well is desirable at minimum cost, a 4.5"OD fixed curved channel connector may be shop-fabricated by the method of the fourth embodiment, using a casing element of same inside diameter as that of the existing casing. The accurately cut lower end of this channel effectively serves as a template for the accurate explosive cutting, downhole, of a window in the existing casing and for achieving a sealed/welded connection of the branch well to the casing, while providing permanent re-inforcement to the windowed casing interval, as shown in FIG. 9, 9AA, 9B and 9BB.

The lower end of the curved channel 41 obtained by this method presents a curved surface which conforms exactly with that of the inside surface of the existing casing, when pressed against it by an eccentering device 45. The thick end plate 42 will also guide the straight upper end of the channel tangentially against the inner wall of the casing when it is inserted into the existing well at the end of a work string.The thick end plate also presents a hole 46 of about 2" ID providing by-pass fluid and tool access to the existing vertical well below the branch-well connection.

The curved channel end is affixed to drillable tie ribs and closed by a drillable bent plate 47, so as to form a pressure-resistant enclosed air-filled space. Along the elliptical edge of the plate and on its inner surface, is affixed a cordon of high explosive, a "shaped" charge ring 48 with a "V" shape metal liner 49 facing outward along the periphery of the plate and with a dense backing housing 50 made of drillable metal facing the interior of the curved channel. The orientation of the "V" liner is such as to aim the gaseous sheet of high-pressure and very hot explosion products toward the edge of the bent plate, at its junction with the lower end of the channel.

A similar linear "shaped" charge 51 is also affixed to the vertical center line of the plate, on the inside ribbed face. This linear charge does not have any metal liner 48 on its "V" surface.

Known detonating cords 52 are affixed respectively to the backing housing of the elliptical charge and, through an additional time delay detonating cord 52, to the linear charge 51.

A known detonator 53 and a firing system 54 of the type used in tubing-conveyed casing perforators complete the pre-fabricated curved channel assembly. The assembly is run-in the existing well to the kick-off depth, by an empty work string, and oriented by known methods in the direction specified for the branch well. It is firmly clamped against the casing wall inner surface and detonated. The results of the detonation are:

1) a continuous inch-wide groove cut in the casing wall and cement adjacent to the edge of the drillable plate, with complete destruction of the peripheral zone of the plate and casing behind it, opposite the outer shaped charge,
2) a bending and welding of the slightly enlarged lower end of the curved channel to the remaining casing wall, thus achieving a metal/metal seal, at their junction,
3) the remaining elliptical portions of the cut casing and of the cover plate 47 are folded together along their longitudinal axis, by the detonation of the linear charge 51, making them easy to remove with a known magnetized fishing tool.

Debris from the charges casings are then drilled out by the drill string inserted into the curved channel to start drilling the lateral branch-well.

After reaching the target depth, the branch-well is completed with a liner string hung and cemented within the fixed curved channel.

A separate tubing string may later be installed by known methods to connect the branch-well to the surface.

The eccentering device used to clamp the lower part of the fixed channel assembly against the casing wall may also be drilled out through the hole in the thick end plate to allow sufficient access to logging and cleaning tools in the vertical well below the branch well To enhance the quality of the explosively bonded metal/metal seal it is advantageous to remove any scale from the old casing wall prior to run-in of the fixed channel assembly, also cleaned of any surface oxides during its fabrication in the shop and coated with Aluminum paint.

This completes the low-cost and rapid installation of a single pre-fabricated fixed curved channel above the perforated zone of an existing cased well.

It will be apparent to those skilled in the Art that the same methods of pre-fabrication and field installation of a bent tubular connector in an existing casing are not limited to the case when the flow path to the casing space below said connector is realized by a parallel tubing element, outside said connector, or by an eccentered annulus, as described above.

They are equally applicable to the case when such by-pass flow path across the intersection with the lateral well is provided by an inner tubing element penetrating the lower wall of the curved tubular connector through a small window and coming out into a packer set at some distance below the casing window . In that case, the small window cut in the lateral connector tube is covered and sealed by a drillable plate. This allows to maintain the lateral connector and it shaped charges at atmospheric pressure, prior to the firing. The end plate at the upper end of the lateral connector may also be replaced by a known hanger set in the casing, so as to conform with the usual configuration for that case.

After firing of the charges to install the lateral connector and clean-up of debris, the lateral drainhole is drilled through the bent tubular connector by known methods. A liner string is run in the drainhole through the explosive-welded window, hung and cemented within the connector, up to a depth between the top of the casing window and the base of the connector hanger.

A small window is cut through the cemented liner and through the drillable cover plate of the connector tube window. The inner tubing element is then threaded through that window and stabbed into the packer below the casing window to form a leak-proof connection.

If a separate production tubing is required for each of the two producers, vertical cased well and branch well, a dual tubing hanger may be set in the casing above the branch connection, supporting respectively the tubing string in the branch well and the tubing string in the vertical well.

While certain embodiments of the invention have been specifically disclosed, it should be understood that the invention is not limited thereto, as many variations will be readily apparent to those skilled in the Art and the invention is to be given the broadest possible interpretation.

I claim:

1. A method of fabrication of a leak-proof multi-lateral casing/liner branch tubular connector, from metal blank tubular casing and liner elements having outer and inner wall surfaces, prior to their inclusion in a casing string of casing elements and prior to the cementation of said casing string into a borehole, comprising the steps of:

inserting and positioning a blank tubular casing element within a re-usable rigid tubular corset with said rigid tubular corset and said casing element having a common longitudinal axis, said tubular casing element having upper and lower ends protruding from said rigid tubular corset, said rigid tubular corset presenting a corset window having a window edge and dimensions slightly greater than the dimensions of a casing window cutout required for making a tight casing/liner connection at a specified kick-off angle, said rigid tubular corset also having a plurality of spaced and oriented small holes located outside of said corset window, firmly holding said blank tubular casing element in co-axial cylindrical position with and within said rigid tubular corset by a plurality of fastening means cooperating with said small holes in said rigid tubular corset for transmitting compressive forces from said rigid tubular corset to said outer wall surface of said tubular casing element, inserting a multi-purpose stiffening internal in said tubular casing element, said internal including a guiding channel for directing a branch tubular connector liner element at said specified kick-off angle from said tubular casing element, precisely positioning said internal across a depth interval of said tubular casing element with respect to said corset window, affixing said internal to said inner wall surface of said tubular casing element by a plurality of drillable fastener as a structural reinforcement offsetting the anticipated reduction in strength resulting from cutting an elongated casing window into said tubular casing element, said internal providing dual channel inlets at one end of said internal including at least one by-pass flow channel for fluids and cement slurries in said tubular casing element across said depth interval covered by said internal, accurately cutting said casing window cutout into and through said tubular casing element inner and outer wall surfaces by means of a cutting tool guided by said guiding channel to produce a windowed tubular casing element having an accurately cut surface at said edge of said casing window cutout, said cutting tool being guided in part by said window edge of said corset window, inserting a liner element into said casing window cutout, machining at least one end of said liner element to achieve a close fit of said machined end of said liner element with said accurately cut edge surface of said casing window cutout, plugging-off said casing window cutout with a drillable ribbed cover plate stiffener shaped to materialize the double curvature, in space, of said casing window cutout, equipping the upper and lower ends of said tubular casing element protruding from said rigid tubular corset with fastening means capable of providing a leak-proof connection between said windowed tubular casing element and adjacent casing elements of a casing string, releasing said compressive forces applied from said rigid tubular corset to the outer surface of said windowed tubular casing element, and removing said plurality of fastening means between said rigid tubular corset and said windowed tubular casing element outer surface to allow the extraction of the completed casing/liner branch tubular connector from said rigid tubular corset.

2. A method of fabrication of a leak-proof, multi-lateral casing/liner branch tubular connector, according to claim 1, including, the steps of:

selecting said internal from a group including:

a) a dual-channel whipstock equipped with a top guide plate presenting, in addition to said dual channel inlets, two smaller holes, one of said holes being connected to the entry of said by-pass flow channel and being threaded at both ends, or b) at least one curved liner channel, welded at its upper end to plate presenting at least one additional hole to provide said by-pass flow channel adjacent to the inlet to said curved liner channel, beveling said machined edge of said casing window cutout using a beveling tool guided in part by said rigid tubular corset window's edge, permanently affixing said selected internal to said tubular casing element by a continuous multi-pass weld along said beveled edge of said casing window cutout, and affixing and sealing said drillable ribbed cover plate to said welded elliptical edge by drillable means.

3. The method of claim 2 wherein said internal is a dual-channel whipstock and including the steps of:

permanently affixing said dual channel whipstock to an interior wall of said casing element, prior to the cutting of said casing window cutout, and cutting said casing window cutout from the inside of said casing element and to the outside of said casing element using a long-shaft shop tool guided by said dual-channeled whipstock positioned and oriented within said casing element held in said rigid tubular corset, guiding said beveling tool in such a way that the center of said beveling tool reaches the exact center of the corresponding corset window at an angle equal to said specified kick-off angle, with respect to said common longitudinal axis of said rigid tubular corset and said casing element.

4. The method of claim 3 wherein said whipstock is selected from the group including:

a) a solid whipstock having a top and a bottom end and a wedge surface at its top end and presenting a central groove bisecting said wedge surface, or b) a tubular whipstock having a top and a bottom end and an outer wedge surface at its top end and a vertical orientation groove on its inner lateral surface, said orientation groove being adapted to receive a matching pin of a removable core whipstock presenting a wedge surface at its top end and a central groove bisecting said top end wedge surface of said core whipstock, or c) a tubular whipstock having a drillable orientation pin on its inner lateral surface, said orientation pin being adapted to engage a matching lateral groove of a drillable core whipstock.

5. The method of claim 1 further comprising the steps of, accurately cutting said casing window cutout from the outside of said tubular casing element by means of short-shafted cutting tools, and said cutting tools being guided on a plurality of parallel slanted rail surfaces included in an A-frame affixed to said rigid tubular corset and such that the trajectory of said cutting tools is on a cylindrical surface having an axis located in the plane of symmetry of said plurality of rail surfaces, at a specified small angle with respect to the axis of said tubular casing element equal to said specified kick-off angle and passing through the center of said corset window, using for said branch tubular connector a movable straight tubular connector equipped at its upper end with a preinstalled drillable guiding collar, inserting said stiffening internal into said casing window cutout and orienting said stiffening internal in such way that said stiffening internal directs the axis of said branch tubular connector to coincide exactly with that of said cutting tool trajectory.

6. The method of claim 5 wherein said movable straight tubular connector is replaced with a pre-curved liner channel without said guiding collar to be used also as said stiffening internal, including the steps of:

inserting said pre-curved liner channel through said casing window cutout from the outside of said casing element using said parallel rails as support and guide, until the upper end of said pre-curved liner channel protrudes from the upper end of said casing element, machining a circular guide plate having:

an outside diameter equal to the drift diameter of said tubular casing element, a by-pass opening through said guide plate, a tangential inlet hole of diameter equal to the outside diameter of said pre-curved liner channel, welding said guide plate to the protruding upper end of said pre-curved liner channel, along the edge of said tangential inlet hole in said guide plate, pulling said pre-curved liner channel and said guide plate into said casing element by applying a pulling force on the protruding lower end of said pre-curved liner channel also protruding from said casing window of said casing element, guiding a milling tool into said pre-curved liner channel by said rail system and by said corset window edge to simultaneously cut-off the protruding lower end of said pre-curved liner channel and to bevel the outer edge of said casing element window cutout to produce a beveled junction between said pre-curved liner channel and said casing element outer surface, applying a multi-pass finished weld at said beveled junction between said pre-curved liner channel and said casing element outer surface, releasing said forces applied from said rigid tubular corset to the outer surface of said windowed casing element and removing said drillable fasteners connecting said casing element to said rigid tubular corset, pulling said windowed casing element permanently stiffened by said welded internal out of said rigid tubular corset and affixing a drillable cover plate to said beveled and welded areas, and sealing the bottom end of said pre-curved liner channel to complete said casing liner branch tubular connector.

7. The method of claim 1 including the steps of, machining said accurately-cut edge of said casing window cutout with a groove suitable for an elastomeric "O" ring-type seal, using a tool guided in part by said rigid tubular corset window edge, positioning said stiffening internal including a retrievable wedge whipstock having a lateral wedge surface and a central orientation groove bisecting said wedge surface within said casing element, said wedge whipstock having a diameter smaller than said casing element drift diameter so as to create an annulus between said whipstock and said casing element, milling out said plurality of drillable fasteners used for affixing said stiffening internal with said wedge whipstock lateral wedge surface to said windowed casing element using an over-shot cutting tool in said annulus, said liner element is a movable straight tube having a machined upper end and lower end, machining at least said upper end of said liner element to fit with said accurately-cut edge of said casing window cutout, and equipping said liner element with a drillable collar presenting a pin matching said central orientation groove of said lateral wedge surface of said whipstock, said drillable collar being affixed to said machined upper end of said liner element, cutting said lower end of said liner element with a straight-cut and plugging said cut lower end with drillable material, said by-pass flow channel being provided by said annulus between said retrievable whipstock and said casing element.

8. The method of claim 7 wherein, said retrievable wedge whipstock used as a stiffening internal is replaced by a permanent tubular wedge whipstock attached to said windowed casing element by said plurality of fasteners and equipped with a vertical orientation groove, and adding the following steps:

inserting a removable grooved whipstock core equipped with a lateral orientation pin matching said vertical orientation groove into said permanent tubular wedge whipstock, said plurality of fasteners affixing said permanent tubular wedge whipstock to said windowed casing element being permanent and made of non-drillable material.

9. The method of claim 5 wherein, said stiffening internal includes a drillable cylindrical rod assembly made of two wedge-shaped halves having a slanted plane of juncture affixed to each other by temporary fasteners located on the outer surface of said cylindrical rod assembly and across said slanted plane of junction, said cylindrical rod assembly having a main internal slant ed cavity along its axis, and adding the following steps:

using for said inserted liner element a movable straight liner stub having an upper and lower end, each end being machined and located within said main internal slanted cavity of said cylindrical rod assembly, making said movable straight liner stub telescopically extendable from fully retracted position to fully extended position into an enlarged borehole filled with wet cement, guiding said liner during its extension by a drillable dual cage guide element, said dual cage guide element sliding into a plurality of slanted grooves in diametrical planes of the main internal slanted cavity, including in said dual cage guide element an inner cage and an outer cage, co-axial with and respectively inside and outside of said movable straight liner stub and each having an upper and lower end, inserting said outer cage element through said casing window cutout into said slanted grooves of said main internal slanted cavity, inserting said liner stub into the space separating said outer cage from said inner cage, fastening said movable straight liner stub upper end to said lower end of said outer cage by temporary fasteners whereby said movable straight liner stub can be fully retracted into said main internal slanted cavity within said cyndrical rod assembly, cutting said lower end of said fully retracted movable straight liner stub with a cutting tool guided respectively by said rail system and said rigid tubular corset window machined edge, affixing drillable rib ties transversely across said machined lower end of said movable straight liner stub, to prevent distortion of said stub lower end, pulling out said movable straight liner stub through said casing window cutout and said rigid tubular corset window to its fully extended position without any rotation around the axis of said movable straight liner stub and cutting said upper end to produce a cut movable straight liner stub using said cutting tool guided by said rail system and said rigid tubular corset window machined edge, removing said temporary fasteners and pulling said cut movable straight liner stub out from its dual cage guide, machining an "O" ring groove along the edge of the outer surface of said casing window cutout, using said tools and tool guiding systems, placing an elastomeric "O"ring within said "O" ring groove to form a seal between said tubular casing element and said movable straight liner stub, affixing a drillable guide collar to the upper end of said movable straight liner stub by drillable means, removing said cylindrical rod assembly's temporary fasteners, pulling said assembly out from said casing element, disassembling said fully machined movable straight liner stub, with said guide collar and placing said movable straight liner stub into said main internal slanted cavity for a complete re-assembled and functional testing of said cylindrical rod assembly and telescopic stub system, returning said cylindrical rod assembly to said casing element and fastening said cylindrical rod assembly to said casing wall by permanent drillable fasteners, relieving said forces applied from said rigid tubular corset to the windowed stiffened casing element and removing all connections with said rigid tubular corset, and pulling said shop-tested casing element from said rigid tubular corset, applying leak-proof fastening means to each end of said casing element and affixing a bent cover plate to said transverse rib ties at said lower end of said movable straight liner stub by drillable means, to stiffen said plate and to seal said plate against said elastomeric "O" ring seal at said edge of said casing window cutout.

10. A method of fabrication of a leak-proof multi-lateral casing/liner branch tubular connector, from metal blank tubular casing an liner elements having outer and inner wall surfaces, comprising the step of:

inserting and positioning a blank tubular casing element within are re-usable rigid tubular corset presenting an corset window, said rigid tubular corset having a plurality of spaced and oriented small holes located outside of said corset window, firmly holding said blank tubular casing element in co-axial cylindrical position with and within said rigid tubular corset by a plurality of fastening means cooperating with said small holes in said rigid tubular corset, inserting a multi-purpose stiffening internal in said tubular casing element, accurately positioning said internal across a depth interval of said tubular casing with respect to said corset window, affixing said internal to the inner wall surface of said casing element by a plurality of drillable fasteners, accurately cutting a casing window cutout into and through said tubular casing element inner and outer wall surfaces by means of a cutting tool, said cutting tool being guided in part by the edge of said corset window and producing a machined edge at said casing window cutout, inserting a liner element into said casing window cutout, machining at least one end of said liner element to achieve a close fit with said machined edge of said casing window cutout, plugging-off said casing window cutout with a drillable cover plate, releasing the compressive forces applied from said corset to the outer surface of said windowed tubular casing element and removing said plurality of fastening means between said rigid tubular corset and said windowed tubular casing element outer surface to allow the extraction of the completed casing/liner branch tubular connector from said rigid tubular corset.

* * * * *